US010699842B2

(12) United States Patent
Graham et al.

(10) Patent No.: US 10,699,842 B2
(45) Date of Patent: Jun. 30, 2020

(54) MAGNETICALLY DOPED ADHESIVE FOR ENHANCING MAGNETIC COUPLING

(71) Applicant: Apple Inc., Cupertino, CA (US)

(72) Inventors: Christopher S. Graham, Cupertino, CA (US); Karl Ruben K. Larsson, Cupertino, CA (US); Paul J. Thompson, Cupertino, CA (US); Eric S. Jol, Cupertino, CA (US); John S. Mosy, Cupertino, CA (US); Albert J. Golko, Cupertino, CA (US); Stephen E. Yao, Cupertino, CA (US); Makiko K. Brzezinski, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 310 days.

(21) Appl. No.: 14/843,687

(22) Filed: Sep. 2, 2015

(65) Prior Publication Data

US 2016/0064141 A1 Mar. 3, 2016

Related U.S. Application Data

(60) Provisional application No. 62/044,600, filed on Sep. 2, 2014.

(51) Int. Cl.

| | |
|---|---|
| ***H01F 38/12*** | (2006.01) |
| ***H01F 27/36*** | (2006.01) |
| ***H01F 27/24*** | (2006.01) |
| ***H01F 1/26*** | (2006.01) |
| ***H01F 1/37*** | (2006.01) |
| ***H01F 38/14*** | (2006.01) |

(52) U.S. Cl.
CPC ..... *H01F 27/365* (2013.01); *H01F 1/26* (2013.01); *H01F 1/37* (2013.01); *H01F 27/24* (2013.01); *H01F 38/14* (2013.01)

(58) Field of Classification Search
USPC ..... 336/84 M, 84 C, 84 R
See application file for complete search history.

(56) References Cited

U.S. PATENT DOCUMENTS

| | | |
|---|---|---|
| 2,471,869 A | 5/1949 | Gebel |
| 3,676,814 A | 7/1972 | Trunzo et al. |

(Continued)

FOREIGN PATENT DOCUMENTS

| | | |
|---|---|---|
| CN | 102611215 | 7/2012 |
| CN | 102741954 | 10/2012 |

(Continued)

*Primary Examiner* — Elvin G Enad
*Assistant Examiner* — Kazi S Hossain
(74) *Attorney, Agent, or Firm* — Kilpatrick Townseond & Stockton LLP

(57) ABSTRACT

In some embodiments, an electronic device includes an electronic component that is at least partially encapsulated by an adhesive doped with soft magnetic material that functions as an EMI shield for the electronic component. In various embodiments, an electronic device includes a first magnetic component separated from a second magnetic component by a gap within which is positioned an adhesive doped with soft magnetic material. The doped adhesive is positioned in a magnetic path between the first and second magnetic components and aids in magnetically coupling the first and second magnetic components and/or guides magnetic flux between the first and second magnetic components.

11 Claims, 4 Drawing Sheets

(56) References Cited

U.S. PATENT DOCUMENTS 4,908,347 A 3/1990 Denk
5,708,362 A 1/1998 Frese et al.
5,872,500 A 2/1999 Gore
5,903,134 A 5/1999 Takeuchi
5,979,087 A 11/1999 Bell et al.
6,667,435 B1 12/2003 French et al.
7,477,039 B2 1/2009 Rodarte
7,538,977 B2 5/2009 Gider et al.
7,710,071 B2 5/2010 Elizalde Rodarte
7,948,208 B2 5/2011 Partovi et al.
7,952,322 B2 5/2011 Partovi et al.
8,169,185 B2 5/2012 Partovi et al.
8,248,025 B2 8/2012 Sip
8,497,657 B2 7/2013 Franks et al.
8,629,652 B2 1/2014 Partovi et al.
8,629,654 B2 1/2014 Partovi et al.
8,704,628 B2 4/2014 Kook
8,823,238 B2 9/2014 Greaves et al.
8,890,470 B2 11/2014 Partovi
8,896,264 B2 11/2014 Partovi
8,901,775 B2 12/2014 Armstrong et al.
8,901,881 B2 12/2014 Partovi
8,922,162 B2 12/2014 Park et al.
8,947,047 B2 2/2015 Partovi et al.
9,106,083 B2 8/2015 Partovi
9,112,362 B2 8/2015 Partovi
9,112,363 B2 8/2015 Partovi
9,112,364 B2 8/2015 Partovi
9,178,369 B2 11/2015 Partovi
9,240,270 B2 1/2016 Wu et al.
2009/0121677 A1* 5/2009 Inoue ..... H01M 10/425 320/108
2009/0121955 A1* 5/2009 Kubo ..... G06K 19/07749 343/788
2009/0237194 A1* 9/2009 Waffenschmidt ... H01F 27/2804 336/115
2010/0181842 A1* 7/2010 Suzuki ..... H01F 38/14 307/104
2010/0207714 A1* 8/2010 Lai ..... H01F 27/22 336/61
2011/0050164 A1 3/2011 Partovi et al.
2011/0062793 A1* 3/2011 Azancot ..... H01F 38/14 307/116
2011/0221385 A1 9/2011 Partovi et al.
2012/0057322 A1* 3/2012 Waffenschmidt ..... H01F 27/365 361/816
2012/0262265 A1* 10/2012 Lo ..... H01F 27/022 336/83
2013/0038278 A1* 2/2013 Park ..... H02J 7/00 320/108
2013/0049484 A1 2/2013 Weissentern
2013/0093388 A1 4/2013 Partovi
2013/0099563 A1 4/2013 Partovi et al.
2013/0229254 A1* 9/2013 Lee ..... H01F 27/263 336/220
2013/0249479 A1 9/2013 Partovi
2013/0260677 A1 10/2013 Partovi
2013/0271069 A1 10/2013 Partovi
2013/0285604 A1 10/2013 Partovi
2013/0285605 A1 10/2013 Partovi
2013/0300204 A1 11/2013 Partovi
2014/0103873 A1 4/2014 Partovi et al.
2014/0132210 A1 5/2014 Partovi
2014/0191568 A1 7/2014 Partovi
2014/0306654 A1 10/2014 Partovi
2015/0055311 A1* 2/2015 Kawarai ..... H05K 1/0233 361/782
2015/0130412 A1 5/2015 Partovi
2015/0145475 A1 5/2015 Partovi et al.
2015/0270058 A1 9/2015 Golko et al.
2015/0348696 A1* 12/2015 Lohr ..... H01F 27/2804 336/84 C
2015/0371768 A1* 12/2015 Graham ..... H01F 27/365 320/108
2016/0006288 A1 1/2016 Wagman et al.
2016/0172086 A1* 6/2016 Habu ..... H01F 1/12 428/206

FOREIGN PATENT DOCUMENTS

CN 102952474 3/2013
CN 203381512 1/2014
CN 203434644 2/2014
CN 203466005 3/2014
EP 1511370 3/2007
EP 1790196 7/2012
EP 2535906 12/2012
JP 2012199370 10/2012
JP 2012222926 11/2012
WO WO03/081976 10/2003
WO WO2009/105615 8/2009
WO WO2012/152980 11/2012
WO WO2013/035282 3/2013
WO WO2014/036558 3/2014

* cited by examiner

MAGNETICALLY DOPED ADHESIVE FOR ENHANCING MAGNETIC COUPLING

CROSS-REFERENCE TO RELATED APPLICATION

This application is a nonprovisional patent application of and claims the benefit to U.S. Provisional Patent Application No. 62/044,600, filed Sep. 2, 2014 and titled "Reducing EMI and/or Improving Magnetic Coupling Using Soft Magnetically Doped Adhesives," the disclosure of which is hereby incorporated herein by reference in its entirety.

FIELD

This disclosure relates generally to adhesives, and more specifically to using soft magnetically doped adhesives to reduce EMI and/or improve magnetic coupling.

BACKGROUND

Encapsulants may be used to protect sensitive components, such as electronic components incorporated into an electronic device, from contaminants. Such contaminants may include water, dust, and/or other such contaminants that may corrode and/or otherwise damage components. For example, adhesives may be utilized to encapsulate electronic components.

Additionally, electronic devices (and/or electronic components of electronic devices) may emit electromagnetic interference or electromagnetic "noise." Governmental and/or other regulations may require those emissions to be within and/or below certain thresholds. Additionally, such emissions may interfere with the operation of other components. Metal shields, such as cans or covers, may be used to reduce electromagnetic interference by channeling the emitted noise and/or converting the emitted noise into heat.

Further, various devices may include multiple proximate magnetic components that are magnetically coupled. Positioning the magnetic elements proximate to each other may result in an air and/or other gap. Such a gap may cause the magnetic coupling between the magnetic components to be looser than would otherwise be possible without the gap.

SUMMARY

The present disclosure describes systems, apparatuses and methods for reducing EMI and/or improving magnetic coupling using soft magnetically doped adhesives. In various implementations, an electronic device may include an electronic component at least partially encapsulated by an adhesive doped with soft magnetic material that functions as an EMI shield. In some embodiments, the doped adhesive may be tuned for a specific electromagnetic interference level and/or electromagnetic interference frequency range utilizing a variety of different factors such as the amount of the soft magnetic material, the particle size of the soft magnetic material, the content of the soft magnetic material, and so on.

In some implementations, an electronic device may include an electronic component and an adhesive doped with soft magnetic material encapsulating at least part of the electronic component, wherein the adhesive functions as an electromagnetic interference shield for the electronic component.

In other implementations, an electronic device may comprise a first magnetic component that is separated from a second magnetic component by a gap; and an adhesive doped with soft magnetic material positioned within the gap in a magnetic field between the first magnetic component and the second magnetic component. The gap may be within the first electronic device. An adhesive doped with soft magnetic material is positioned within at least part of the gap; the doped adhesive may contact or at least partially surround the first magnetic component, as well. The doped adhesive may be positioned between the first and second magnetic components and may aid in magnetically coupling the first and second magnetic components and/or guiding magnetic flux between the first and second magnetic components, for example by directing, enhancing or strengthening a magnetic field between the first and second magnetic components. In some embodiments, the doped adhesive may also be positioned in one or more gaps between a magnetic component and a nonmagnetic component.

In various implementations, an electronic device may include an electronic component and an adhesive doped with soft magnetic material encapsulating at least part of the electronic component. The adhesive may function as an electromagnetic interference shield for the electronic component.

In some implementations, an electronic device may include a first magnetic component that is separated from a second magnetic component by a gap and an adhesive doped with soft magnetic material positioned within the gap in a magnetic path between the first magnetic component and the second magnetic component.

In some implementations, a method for reducing electromagnetic interference may comprise: doping an adhesive with soft magnetic material; and encapsulating at least part of an electronic component with the doped adhesive; wherein the doped adhesive functions as an electromagnetic interference shield for the electronic component.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION

The description that follows includes sample systems, methods, and apparatuses products that embody various elements of the present disclosure. However, it should be understood that the described disclosure may be practiced in a variety of forms in addition to those described herein.

The present disclosure describes systems, apparatuses, and methods for reducing electromagnetic interference ("EMI") and/or improving magnetic coupling using soft magnetically doped adhesives. In various implementations, an electronic device may include an electronic component that is at least partially encapsulated by an adhesive doped with soft magnetic material (e.g., materials, such as ferromagnetic materials, that may be temporarily magnetized or that may react to a magnetic field but do not tend to stay magnetized). The doped adhesive may function as an EMI shield for the electronic component. Sample electronic components include, but are not limited to, printed circuit boards and circuits or other elements disposed thereon, processors, memory or other storage devices, inductive transmitters and/or receivers, and so on.

In some embodiments, the doped adhesive may be tuned for a specific electromagnetic interference level and/or electromagnetic interference frequency range. The doped adhesive may be tuned utilizing a variety of different factors such as the amount of the soft magnetic material, the particle size of the soft magnetic material, the content of the soft magnetic material, and so on.

In some implementations, an electronic device may include a first magnetic component that is separated from a second magnetic component by a gap and an adhesive doped with soft magnetic material positioned within the gap. The doped adhesive may be positioned in a magnetic path (e.g., within a magnetic field or a space through which a magnetic field passes) between the first and second magnetic components and may aid in magnetically coupling the first and second magnetic components and/or guiding magnetic flux between the first and second magnetic components, for example by directing, enhancing or strengthening a magnetic field between the first and second magnetic components.

In some embodiments, the doped adhesive may also be positioned in one or more other gaps between the first magnetic component and a nonmagnetic component. For example, the doped adhesive may be used to backfill gaps between the first magnetic component and a housing.

Figure 1:
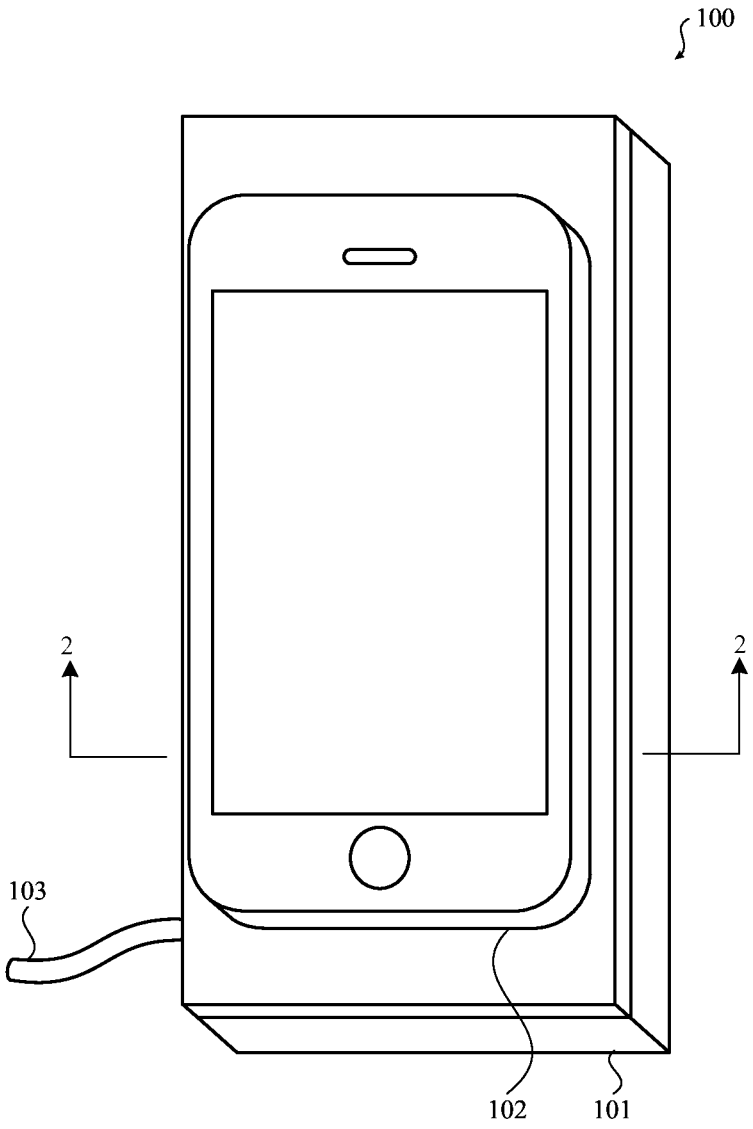
FIG. 1 depicts a sample inductive power transmission system.

FIG. 1 illustrates a sample inductive power transmission system 100. The system 100 may include a first electronic device 101 and a second electronic device 102. As illustrated, the first electronic device may be a charging pad and the second electronic device may be a smart phone. The charging pad may inductively transmit power from an alternating current power cord 103 to the smart phone, which the smart phone may store in one or more batteries. However, it is understood that this is an example. In various implementations, the first and/or second electronic device may be any electronic devices such as a desktop computer, a laptop computer, a cellular telephone, a dock, a charger, a wearable device, a digital media player, an electronic kitchen appliance, and/or any other electronic device.

Figure 2:
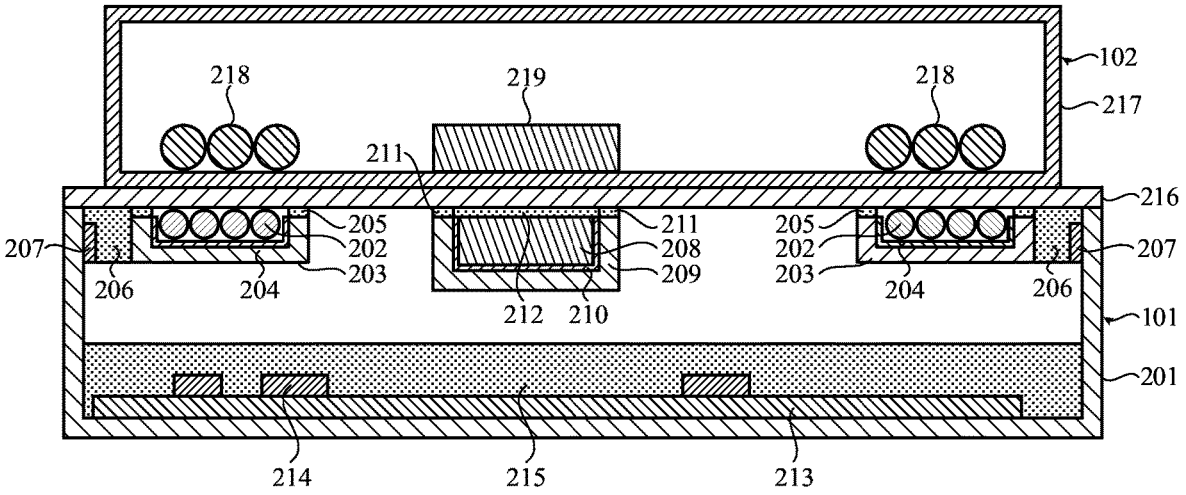
FIG. 2 is a cross-section view of the system of FIG. 1 taken along line 2-2 of FIG. 1.

FIG. 2 is a cross-sectional view of the system 100 of FIG. 1 taken along the line 2-2 of FIG. 1. As illustrated, the first electronic device 101 may include a transmit coil 202 positioned adjacent to a cap 216 of a housing 201 and the second electronic device 102 may include a receive coil 218 positioned within a housing 217. The first electronic device may be operable to run an alternating current through the transmit coil. This may create a magnetic field that induces a current in the receive coil, thereby enabling the second electronic device to inductively receive power from the first electronic device. The first and second electronic devices may also include alignment magnets 208 and 219 (which may be hard magnets or ferromagnetic materials that can be magnetized and tend to stay magnetized, soft magnets, and/or electromagnets), which may aid in aligning the transmit and receive coils for inductive power transmission and/or other purposes.

Further, the first electronic device may include a direct current (DC) shield 209, coil shields 203, components 207, and a printed circuit board (PCB) 213 that includes components 214. The DC shield (which may be formed of one or more soft magnetic materials) may shield other components of the first electronic device from the alignment magnet 208 and/or the alignment magnet 208 from other components. The DC shield may also guide the magnetic field of the alignment magnet 208 toward the alignment magnet 219. Similarly, the coil shields (which also may be formed of one or more soft magnetic materials) may shield other components of the first electronic device from the transmit coil 202 and/or the transmit coil from other components. The coil shields may also guide the magnetic field created by the transmit coil toward the receive coil 218.

Though not illustrated, the first and/or second electronic device may include one or more additional components such as one or more processing units, one or more batteries, one or more input/output components, one or more communication components, one or more non-transitory storage media (which may take the form of, but is not limited to, a magnetic storage medium; optical storage medium; magneto-optical storage medium; read only memory; random access memory; erasable programmable memory; flash memory; and so on), and/or one or more of a variety of different components not shown.

As illustrated, the PCB 213 is partially encapsulated by an adhesive 215. By encapsulating the PCB, the adhesive 215 may be bonded to the PCB and may protect the PCB by forming a barrier against contaminants such as water, dust, and/or other contaminants. The adhesive bonding may prevent formation of cracks or gaps that could admit contaminants. The adhesive 215 may also be doped with one or more soft magnetic materials such that the adhesive 215 functions as an EMI shield for the PCB. Due to the proximity of the adhesive 215 to the PCB, the adhesive 215 and EMI noise sources (such as the components 214) on the PCB may be tightly coupled electromagnetically and thus the adhesive 215 may be able to significantly reduce the EMI noise emitted by such sources.

In some implementations, in addition to functioning as an EMI shield the adhesive 215 may be positioned within a gap between magnetic components in a magnetic path between the magnetic components. As such, in such implementations the adhesive 215 may improve magnetic coupling between the magnetic components.

Further, the second electronic device may include adhesives 204, 205, 206, 210, 211, and/or 212 that may be positioned within gaps between magnetic components and/or gaps between magnetic components and other components. As illustrated, adhesive 204 may be positioned within gaps between the transmit coil 202 and the coil shields 203; adhesive 205 may be positioned within gaps between the coil shields and the cap 216, adhesive 206 may be positioned within gaps between the coil shields and internal sides of the housing 201 (as well as the components 207); adhesive 210 may be positioned within gaps between the alignment magnet 208 and the DC shield; adhesive 211 may be positioned within gaps between the DC shield 209 and the cap; and/or adhesive 212 may be positioned within gaps between the alignment magnet and the cap. The adhesives 204, 205, 206, 210, 211, and/or 212 may be doped with one or more soft magnetic materials.

When positioned within gaps between magnetic components, adhesives such as the adhesives 204, 205, 210, 211, and/or 212 may be positioned within a magnetic path between the components. This may reduce or remove air gaps in the magnetic path and may improve magnetic coupling between the magnetic components. The doped adhesive may have a high magnetic permeability than air, for instance.

For example, the adhesive 204 may reduce or remove the air gaps between the transmit coil 202 and the coil shields 203, thereby improving magnetic coupling between the transmit coil and the coil shields and/or aiding in magnetically coupling the magnetic components (which may include guiding magnetic flux between the magnetic components, or directing, enhancing or strengthening a magnetic field between the first and second magnetic components). By way of another example, the adhesive 205 may reduce or remove air gaps between the coil shields and the cap 216, thereby improving magnetic coupling between the transmit coil and the receive coil 218.

In yet another example, the adhesive 210 may reduce or remove the air gaps between the alignment magnet 208 and the DC shield 209, thereby improving magnetic coupling between the alignment magnet 208 and the DC shield. By way of still another example, the adhesive 211 may reduce or remove air gaps between the DC shield and the cap 216 and/or the adhesive 212 may reduce or remove air gaps between the alignment magnet 208 and the cap, thereby improving magnetic coupling between the alignment magnet 208 and the alignment magnet 209.

However, adhesives such as the adhesive 206 may also be positioned between a magnetic component and a nonmagnetic component. Such adhesive may be used to backfill gaps between magnetic components and other components such as housings that may be present due to manufacturing constraints. Magnetic components may be constructed with cutouts and/or other dimensions due to clearances that may be useful when the magnetic components are assembled into devices. For example, the coil shields 203 may better direct magnetic flux from the transmit coil 202 to the receive coil 218 if the coil shields extended to the internal sides of the housing 201. However, this may not be possible, such as due to the location of the components 207. As such, the adhesive 206 may be backfilled into the gap between the coil shields and the internal side of the housing and/or the components 207. As the adhesive 206 is doped with the soft magnetic material, such backfilling may aid the coil shields in the direction of the magnetic flux created by the transmit coil in a manner like what would have been possible if the coil shields had been able to extend to the inner side of the housing had manufacturing constraints not prevented such.

In various implementations, the adhesives 204, 205, 206, 210, 211, and/or 212 may function as an EMI shield for one or more electronic components of the first and/or second electronic devices 101 and 102.

The adhesives 204, 205, 206, 210, 211, 212 and/or 215 may be any kind of adhesive or combination of adhesives including, but not limited to, epoxy, polyurethane, hot melt, pressure sensitive adhesive, and/or glue. The soft magnetic material used to dope the adhesives 204, 205, 206, 210, 211, 212 and/or 215 may be any kind of soft magnetic material and/or combinations of soft magnetic materials including, but not limited to, ferrite materials, carbonyl iron, iron, nickel, cobalt, iron alloys, nickel alloys, or cobalt alloys. Any geometry of soft magnetic material particles may be utilized to dope the adhesives 204, 205, 206, 210, 211, 212 and/or 215 such as flakes, spheres, cubes, irregular shapes, and so on and any size of soft magnetic material particles may be used. Any proportion of soft magnetic material to adhesive may be utilized in doping the adhesives 204, 205, 206, 210, 211, 212 and/or 215.

In some implementations, an adhesive such as the adhesives 204, 205, 206, 210, 211, 212 and/or 215 may be tuned for shielding a particular EMI level or levels and/or EMI frequency ranges. Various factors may be used to tune adhesives for shielding such as an amount of the soft material used for doping, a particle size of the soft magnetic material, a content of the soft magnetic material (such as the dopant used and/or any other materials in or forming the adhesive), and so on. Smaller particle sizes (such as 3 microns) may have lower magnetic permeability and may be more effective at blocking higher EMI frequency ranges (such as 50-70 MHz) whereas larger particle sizes (such as 10 microns) may have higher magnetic permeability and may be more effective at blocking lower EMI frequency ranges (such as 250-350 KHz). Higher proportions of soft magnetic material to adhesive (such as 60% soft magnetic material and 40% adhesive) may be more effective at blocking higher levels of EMI noise (e.g., higher electronic interference levels) and/or higher frequencies of such noise. A "level" may refer to an amount or volume of electronic interference/noise, in contrast with (or in addition to) a frequency of that noise.

For example, the coil shields 203 may operate as EMI shields that block the transmit coil 202 from interference caused by low frequency (such as 300 MHz) EMI noise emitted by one or more components 214. However, the coil shields may not adequately block the PCB 213 from high frequency (such as 50-70 MHz) EMI noise emitted by the transmit coil. This could cause a cable (not shown) connected to the PCB to exceed applicable regulatory limits. However, the doped adhesive 215 partially encapsulating the PCB may be tuned to block or reduce the high frequency EMI noise emitted by the transmit coil. As such, the doped adhesive may prevent high frequency EMI noise emitted by the transmit coil from interfering with the PCB and/or cable, thus enabling the cable to stay within applicable regulatory limits.

However, such higher proportions of soft magnetic material to adhesive may result in the doped adhesive being conductive, discolored (such as where the adhesive is transparent or translucent), and/or other such issues. In some implementations, the doped adhesive may be formed to be nonconductive, such as by utilizing lower proportions of soft magnetic material to adhesive (such as 50% soft magnetic material and 50% adhesive).

In various implementations, insulated soft magnetic material may be utilized to dope adhesives. Use of insulated soft magnetic materials in doping adhesives may enable use of higher proportions of soft magnetic material to adhesive without the doped adhesive being conductive.

Figure 3:
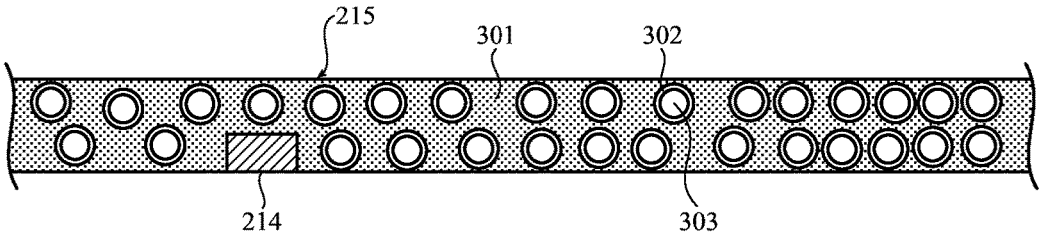
FIG. 3 is an expanded cross-section view of a doped adhesive of FIG. 2 with certain other elements illustrated of FIG. 2 removed for clarity.

For example, the particles of the soft magnetic material may be coated with a nonconductive material. By way of illustration, FIG. 3 is a cross-sectional view of the encapsulating adhesive 215 of FIG. 2 with the other elements of FIG. 2 removed for clarity. As shown, the doped adhesive 215 includes adhesive 301 and soft magnetic material particles 301. The soft magnetic material particles may be coated with nonconductive coatings 302.

However, it is understood that this is an example. In various implementations, a variety of techniques may be utilized to insulate the soft magnetic materials utilized to dope adhesives. For example, in some implementations the adhesive itself may isolate the soft magnetic material particles from each other.

Figure 4:
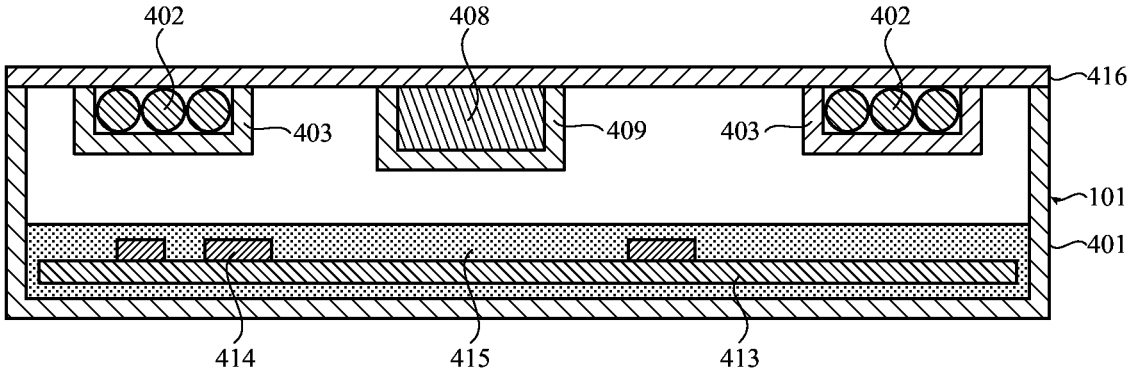
FIG. 4 illustrates a cross-section of another sample electronic device including a doped adhesive.

FIG. 4 illustrates a first alternative embodiment of the system 100 shown in FIG. 2 with the second electronic device 102 removed for clarity. By way of contrast with the system 100 shown in FIG. 2, the PCB 413 may entirely encapsulated in the doped adhesive 415. Further, doped adhesives may not be positioned in gaps between the coil shields 402 and the cap 416, the transmit coil 402 and the coil shields, the DC shield 409 and the cap, the alignment magnet 408 and the cap, the alignment magnet 408 and the DC shield 409, and/or the coil shields and the internal sides of the housing 401.

Figure 5:
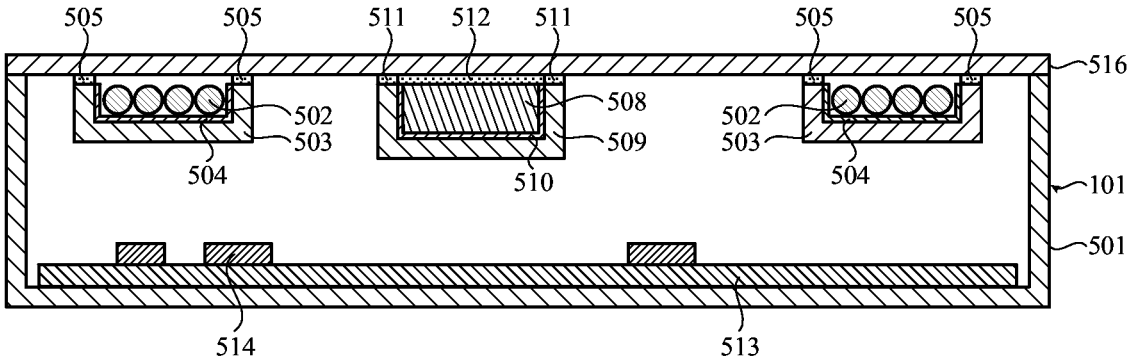
FIG. 5 illustrates a cross-section of still another sample electronic device including a doped adhesive.

FIG. 5 illustrates a second alternative embodiment of the system shown in FIG. 2 with the second electronic device 102 removed for clarity. By way of contrast with the system 100 shown in FIG. 2, the PCB 513 may not be encapsulated with an adhesive.

Although the discussion of reducing EMI and/or improving magnetic coupling using soft magnetically doped adhesives in the present disclosure is illustrated and described in the context of an inductive power transmission system, it is understood that this is an example. In various implementations, the techniques discussed herein may be utilized in a variety of devices, such as electronic devices that are not components of an inductive power transmission system, components of inductive power transmission systems that utilize other components than those discussed above and shown in the accompanying figures, or even devices that are not electronic. The embodiments discussed herein are provided as examples and are not intended to be limiting.

Figure 6:
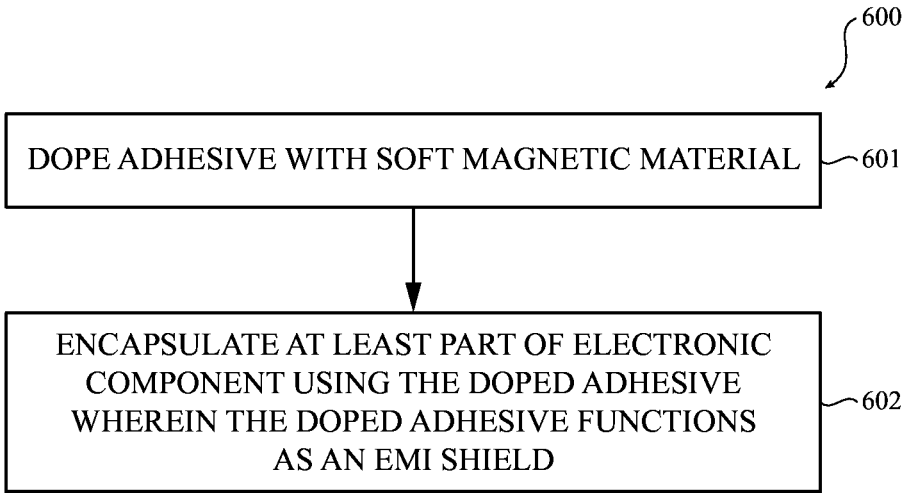
FIG. 6 is a method diagram illustrating a method for reducing electromagnetic interference.

FIG. 6 is a method diagram illustrating a method 600 for reducing electromagnetic interference. This method may be performed by the systems of FIGS. 1-5.

The flow may begin at block 601 and where adhesive is doped with soft magnetic material. The flow may then proceed to block 602 where at least part of an electronic component is encapsulated with the doped adhesive. The encapsulating doped adhesive may function as an EMI shield for the electronic component and/or other components.

Although the method 600 is illustrated and described as including particular operations performed in a particular order, it is understood that this is an example. In various implementations, various orders of the same, similar, and/or different operations may be performed without departing from the scope of the present disclosure.

For example, block 601 is illustrated and described as doping adhesive with soft magnetic material. However, in various implementations an operation of obtaining adhesive doped with soft magnetic material may be performed instead of the operation of doping the adhesive without departing from the scope of the present disclosure.

Figure 7:
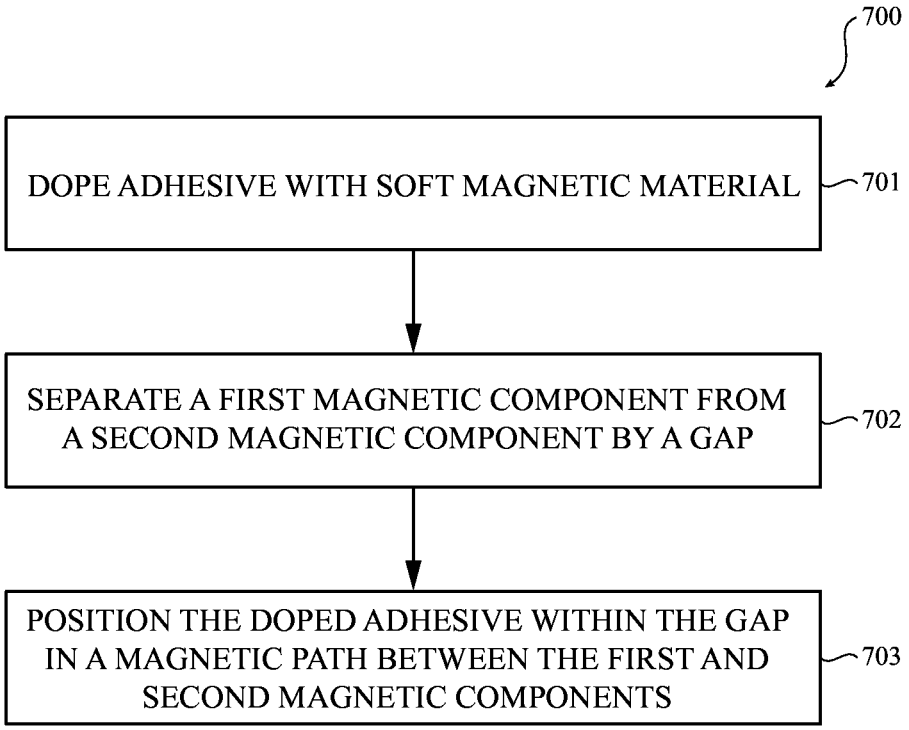
FIG. 7 is a method diagram illustrating a method for improving magnetic coupling.

FIG. 7 is a method diagram illustrating a method 700 for improving magnetic coupling. This method may be performed by the systems of FIGS. 1-5.

The flow may begin at block 701 and where adhesive is doped with soft magnetic material. The flow may then proceed to block 702 where a first magnetic component is separated from a second magnetic component by a gap. Next, the flow may proceed to block 703 where the doped adhesive is positioned within the gap in a magnetic path between the first and second magnetic components.

Although the method 700 is illustrated and described as including particular operations performed in a particular order, it is understood that this is an example. In various implementations, various orders of the same, similar, and/or different operations may be performed without departing from the scope of the present disclosure.

For example, block 701 is illustrated and described as doping adhesive with soft magnetic material. However, in various implementations an operation of obtaining adhesive doped with soft magnetic material may be performed instead of the operation of doping the adhesive without departing from the scope of the present disclosure.

By way of another example, blocks 702 and 703 are illustrated and described as separate, linear operations. However, in various implementations first and second magnetic components may be positioned to create a gap and doped adhesive may be positioned in the gap as part of a single, unitary operation.

By way of yet another example, the method 700 is illustrated and described as positioning the doped adhesive within a gap in a magnetic path between first and second magnetic components. However, in other implementations the doped adhesive may be positioned in a gap between a magnetic component and a nonmagnetic component. As such, in some implementations the doped adhesive may not be positioned within a magnetic path.

As described above and illustrated in the accompanying figures, the present disclosure describes systems, apparatuses, and methods for reducing EMI and/or improving magnetic coupling using soft magnetically doped adhesives. In various implementations, an electronic device may include an electronic component that is at least partially encapsulated by an adhesive doped with soft magnetic material. The doped adhesive may function as an EMI shield for the electronic component. In some implementations, an electronic device may include a first magnetic component that is separated from a second magnetic component by a gap and an adhesive doped with soft magnetic material positioned within the gap. The doped adhesive may be positioned in a magnetic path between the first and second magnetic components and may aid in magnetically coupling the first and second magnetic components and/or guiding magnetic flux between the first and second magnetic components.

In the present disclosure, the methods disclosed may be implemented as sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

Techniques discussed in the described disclosure may be utilized by manufacturing machinery controlled by a computer program product, or software, which may include a non-transitory machine-readable medium having stored thereon instructions, which may be used to program a computer system (or other electronic devices) to perform a process according to the present disclosure. A non-transitory machine-readable medium includes any mechanism for storing information in a form (e.g., software, processing application) readable by a machine (e.g., a computer). The non-transitory machine-readable medium may take the form of, but is not limited to, a magnetic storage medium (e.g., floppy diskette, video cassette, and so on); optical storage medium (e.g., CD-ROM); magneto-optical storage medium; read only memory (ROM); random access memory (RAM);

erasable programmable memory (e.g., EPROM and EEPROM); flash memory; and so on.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

We claim:

1. An electronic device, comprising:

a printed circuit board having at least first and second electronic components disposed thereon and separated from each other by a gap; and a nonconductive adhesive including a soft magnetic material, the nonconductive adhesive formed directly over the printed circuit board and within the gap encapsulating at least part of the printed circuit board and the first and second electronic components, wherein the nonconductive adhesive is tuned for at least one of an electromagnetic interference level or electromagnetic interference frequency range and shields the printed circuit board and first and second electronic components from electromagnetic interference.

2. The electronic device of claim 1, wherein the adhesive is tuned based on an amount of the soft magnetic material, a particle size of the soft magnetic material, or a content of the soft magnetic material.

3. The electronic device of claim 1, wherein the soft magnetic material comprises a plurality of particles that are dispersed within the adhesive, and each particle is coated with an electrically insulative material.

4. The electronic device of claim 1, wherein:

the soft magnetic material comprises at least one of a ferrite material, carbonyl iron, iron, nickel, cobalt, an iron alloy, a nickel alloy, or a cobalt alloy; and the adhesive comprises at least one of epoxy, polyurethane, hot melt, pressure sensitive adhesive, or glue.

5. The electronic device of claim 1, wherein the first and second electronic components comprise integrated circuits.

6. The electronic device of claim 1, wherein the adhesive is bonded to the first and second electronic components.

7. The electronic device of claim 6, wherein:

the adhesive is positioned between the electronic component and a magnetic component;

a magnetic field passes through the adhesive; and the adhesive aids in magnetically coupling the electronic component to the magnetic component.

8. An electronic device comprising:

a housing having a charging surface;

a coil positioned within the housing adjacent to the charging surface;

a coil shield partially surrounding the coil and arranged to guide a magnetic field generated by the coil towards the charging surface;

a printed circuit board positioned within the housing at a location spaced apart from the coil, the printed circuit board having at least first and second electronic components disposed thereon and separated from each other by a gap; and a nonconductive adhesive formed directly over the printed circuit board and the first and second electronic components such that a portion of the nonconductive adhesive is positioned within the gap between the first and second electronic components, wherein the nonconductive adhesive is doped with a soft magnetic material and protects the printed circuit board and first and second electronic components against contaminants, is tuned for at least one of an electromagnetic interference level or electromagnetic interference frequency range, and shields the printed circuit board and first and second electronic components from electromagnetic interference.

9. The electronic device of claim 8, wherein the adhesive includes 50% soft magnetic material and 50% adhesive such that the adhesive is nonconductive.

10. The electronic device of claim 8, wherein the first magnetic component comprises a printed circuit board and the adhesive encapsulates at least part of the printed circuit board and shields the printed circuit board from electromagnetic interference.

11. The electronic device of claim 8, further comprising a permanent magnet disposed adjacent to the charging surface at a location concentric with the coil.

* * * * *